US005615419A

United States Patent [19]

Williams

[11] Patent Number: 5,615,419

[45] Date of Patent: Apr. 1, 1997

[54] TODDLER HELMET

[76] Inventor: Jerry Williams, 113 College Extension Rd., Taylorsville, N.C. 28681

[21] Appl. No.: 561,373

[22] Filed: Nov. 21, 1995

[51] Int. Cl.[6] ..... A42B 3/00

[52] U.S. Cl. ..... 2/411; 2/417; 2/423

[58] Field of Search ..... 2/410, 411, 412, 2/414, 417, 418, 421, 423, 425

[56] References Cited

U.S. PATENT DOCUMENTS

| | | | |
|---|---|---|---|
| 694,986 | 3/1902 | Pierce | 2/414 |
| 1,569,181 | 1/1926 | Hartman | 2/414 |
| 2,706,294 | 4/1955 | Sprinkle | 2/414 |
| 2,717,384 | 9/1955 | Frothingham . | |
| 2,784,408 | 3/1957 | Moore . | |
| 3,171,133 | 3/1965 | Steffen . | |
| 3,555,561 | 1/1971 | Neis | 2/411 |
| 4,068,323 | 1/1978 | Gwon | 2/425 |
| 4,581,773 | 4/1986 | Cunnane . | |
| 4,745,637 | 5/1988 | Steele et al. . | |
| 5,075,903 | 12/1991 | Richoux . | |
| 5,271,103 | 12/1993 | Darnell . | |
| 5,437,064 | 8/1995 | Hamaguchi | 2/414 |
| 5,461,730 | 10/1995 | Carrington | 2/411 |

FOREIGN PATENT DOCUMENTS

| | | | |
|---|---|---|---|
| 286726 | 10/1988 | European Pat. Off. | 2/411 |
| 148735 | 8/1931 | Switzerland | 2/411 |
| 2220556 | 1/1990 | United Kingdom | 2/411 |

*Primary Examiner*—Michael A. Neas
*Attorney, Agent, or Firm*—Shefte, Pinckney & Sawyer

[57] ABSTRACT

A protective helmet for use by children is provided, with a top portion formed as a hollow dome, containing a plurality of ventilation openings. The top portion includes a stretch panel which extends from the top of the dome to a rim of the top portion. The protective helmet also includes a padded brim which is formed as a band mounted to and encircling an outer circumference of the top portion at the rim, and includes a stretch panel adjacent to the stretch panel of the top portion. The protective helmet further includes a first strap and a second strap mounted to the padded brim that are attachable to and detachable from each other. Each strap has an ear protection portion at the point of attachment to the padded brim that is configured to provide protection to the ears of the child, with a plurality of ventilation openings therein for the passage of air and sound. The top portion, padded brim, first strap, and second strap all have an inner and outer layer with flexible, resilient padding disposed therebetween and are constructed of an inexpensive, disposable material.

11 Claims, 2 Drawing Sheets

TODDLER HELMET

BACKGROUND OF THE INVENTION

The present invention relates broadly to protective headgear for children and, more particularly, to a helmet constructed of disposable material that is designed to protect the cranial region of children. The toddler helmet of the present invention is particularly useful when children are just beginning to walk and are prone to fall against walls, chairs, tables, and the like and is also an effective device to protect children who are subject to seizures and may tend to fling their head against the floor, wall, table, or other object.

Head protection for various activities for children and adults is well known. For example, there are motorcycle helmets, football helmets, bicycle helmets, and skydiving helmets, among others. These helmets are all designed for a particular purpose and are effective for the purpose for which they are designed. However, there are few helmets that are designed for general use for infants, toddlers, and other children who are, for example, learning to walk, suffering from a head injury, or subject to seizures. These individuals require protection from head injuries due to falls, bumps, and the like.

U.S. Pat. No. 4,745,637 discloses a head protector for children consisting of a plurality of concentric rings that are packed with a yieldable material that is to be attached to the head. U.S. Pat. No. 3,171,133 discloses a protective helmet constructed of a rigid, unyielding material, wherein the helmet encircles the head without providing protection to the top of the head or the ears. U.S. Pat. No. 5,075,903 discloses infant protection headgear comprising specific protection for the occipital area of the skull. This headgear also provides a padded headband to protect the side and front of the head, but does not provide protection for the top of the head nor for the ears.

Each of the disclosed children's helmets do provide some measure of protection for some area of the head. However, it is desirable to provide a protective helmet for a child's head that contains a suitable amount of padding material to provide adequate protection, provides a snug and comfortable fit for the child, protects the entire upper region of the head and the ears, allows for the circulation of air and sound, and is constructed of a disposable material for the convenience of the parents.

SUMMARY OF THE INVENTION

It is accordingly an object of the present invention to provide a protective helmet for children to be worn on the head that provides protection for the entire upper head region and for the ears, is constructed of sufficient padding material to provide adequate protection, fits snugly and comfortably on the child's head, provides ventilation for circulation of air and sound, and is constructed of disposable material for the convenience of the parents.

The helmet is constructed with a padded top portion that is formed as a hollow dome. The top portion is constructed with an inner layer and an outer layer, with flexible, resilient padding material disposed between the layers. The dome also has a plurality of ventilation openings that allow air circulation. The top portion of the helmet is further constructed with a stretch panel made of elastic material mounted thereto such that it extends from an upper extent to the rim thereof. This stretch panel allows the volumetric capacity of the top portion to be changed by exertion of pressure from within the top portion, thus providing a snug fit on a variety of children's heads.

The helmet also comprises a padded brim which is formed as a band that is mounted to and encircles the rim of the top portion. This padded brim also has an inner layer and an outer layer, with flexible, resilient padding disposed between these layers. The brim further comprises a section of stretch panel that is located adjacent to and of similar dimension to the stretch panel of the top portion.

The helmet further has a first strap mounted to the padded brim and a second strap mounted to the padded brim in a spaced relationship with the first strap. Both straps have distal ends and these distal ends are selectively attachable to and detachable from each other. Each strap also has an ear protection portion at the point where the strap attaches to the padded brim. This ear protection portion is configured to extend in a covering relation with at least part of the user's ear. The ear protection portions contain a plurality of ventilation openings for the passage of air and sound. Each strap also has an inner layer and an outer layer with flexible, resilient padding disposed between the layers.

The entire protective helmet assembly, including the top portion, the padded brim, and the straps, are constructed of disposable material, such as that used for disposable diapers.

DESCRIPTION OF THE PREFERRED EMBODIMENT

Figure 1:
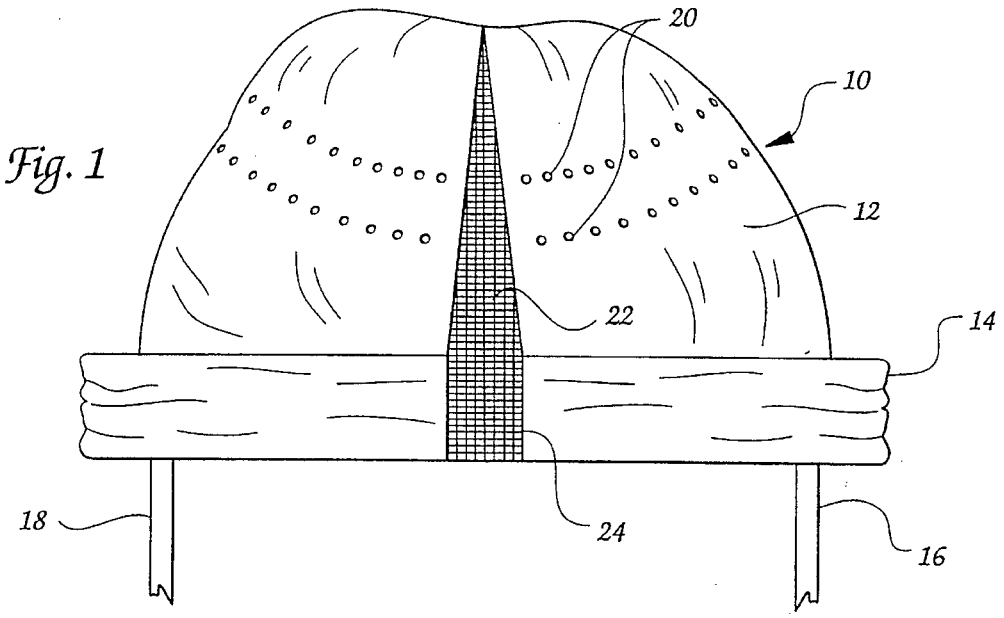
FIG. 1 is a rear elevational view of a toddler helmet according to the preferred embodiment of the present invention.
Figure 2:
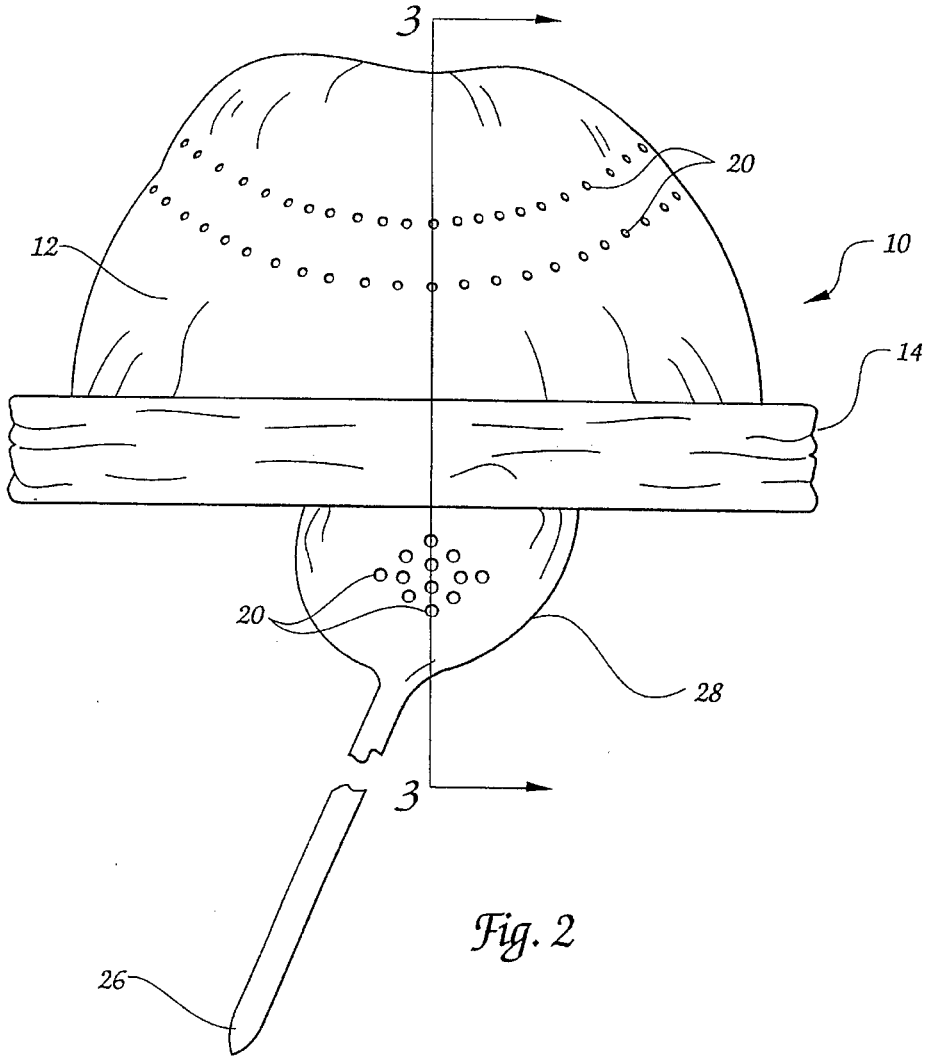
FIG. 2 is a side elevational view of the toddler helmet depicted in FIG. 1.
Figure 3:
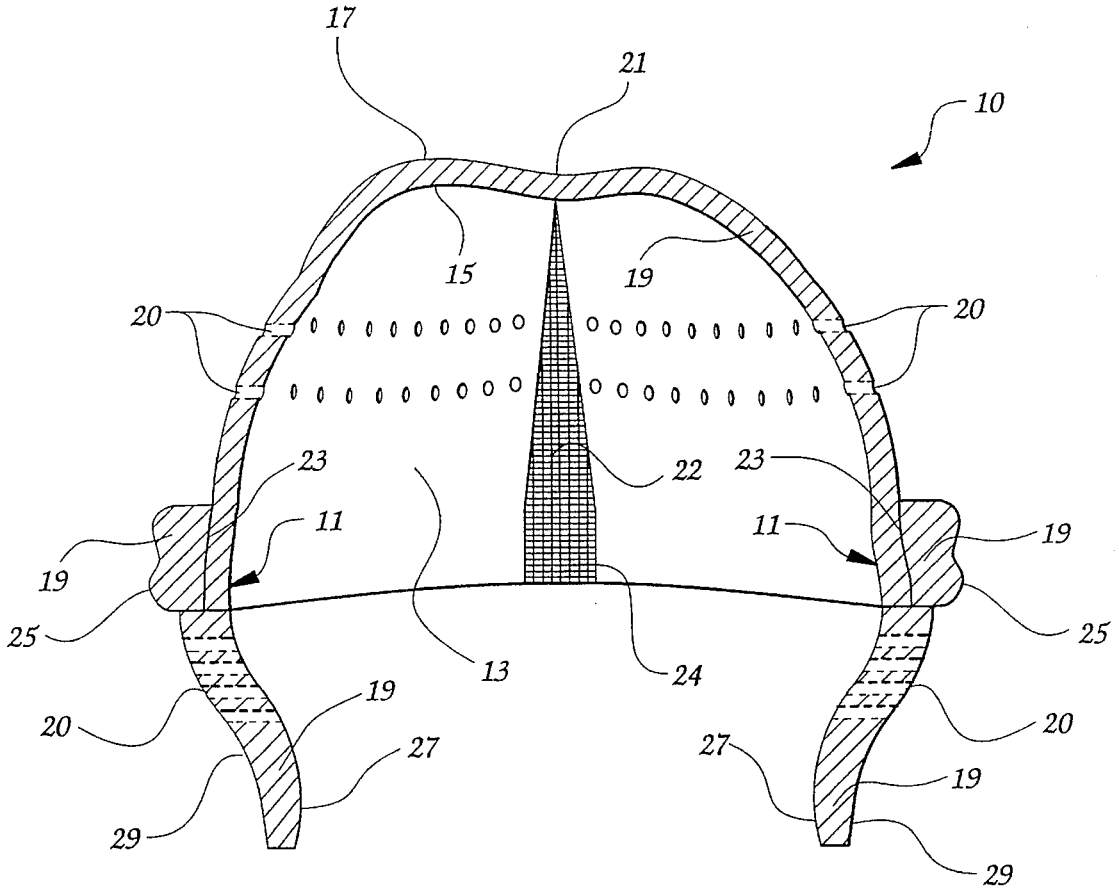
FIG. 3 is a cross-sectional view of the toddler helmet along line 3—3 in FIG. 2.

Turning now to the drawings, and more particularly to FIG. 1, a toddler helmet according to the preferred embodiment of the present invention is illustrated generally at 10 and includes a top portion 12, a padded brim 14, a first strap 16, and a second strap 18.

The top portion 12 is formed as a hollow dome, defining a rim portion 11 and a head receiving cavity 13 with a plurality of ventilation openings 20 formed in the top portion 12 to extend therethrough into the head receiving cavity 13. According to the preferred embodiment, the ventilation openings 20 are formed as a multiplicity of small round apertures arranged in concentric, circular patterns to allow adequate ventilation. The top portion 12 includes an inner layer 15 and an outer layer 17, with flexible, resilient padding 19 disposed between the layers.

The top portion 12 also includes a stretch panel 22 that is formed in part of the top portion 12 and extends from the crown 21 of the top portion 12 to the rim 11 of the top portion 12. The stretch panel 22 is elastically constructed such that when pressure is exerted from within the top portion 12, the volumetric capacity of the top portion 12 is changed. In addition, the helmet may be spread open from without to enlarge the head receiving cavity 13 when placing the helmet 10 onto a child's head. This provides for a snug fit on the child's head, regardless of the size of the child's head. This enhances the comfort provided by the helmet so that the wearer will be less likely to attempt to remove the helmet because of discomfort or a loose fit.

The padded brim 14 is shaped as a band which is mounted to and encircles an outer circumference of the top portion 12 at the rim 11. The padded brim 14 includes an inner layer 23 and an outer layer 25, with flexible, resilient padding 19 disposed between the layers. The padded brim 14 also includes a stretch panel 24 which is located adjacent to and is integral with the stretch panel 22 of the top portion 12.

The first strap 16 and the second strap 18 are mounted to the padded brim 14. The first strap 16 and the second strap 18 are mounted in a spaced relationship, preferably substantially approximately 180° apart. The first strap 16 and the second strap 18 each contain an inner layer 27 and an outer layer 29, with flexible, resilient padding 19 disposed between the layers.

Each strap 16,18 has a distal end 26. The distal end 26 of the first strap 16 is selectively attachable to and detachable from the distal end 26 of the second strap 18. The distal ends 26 fasten to each other at a point under the chin of the user to secure the protective helmet to the head of the user. The means of attachment of the distal ends 26 may be by buckles, snaps, hook-and-loop, adhesive surfaces or the like, or by tying the distal ends 26 together. In the preferred embodiment, the distal ends 26 are adjustably attachable to each other by adhesive tabs.

The first strap 16 and the second strap 18 each have an ear protection portion 28 at the point of attachment to the padded brim 14. The ear protection portion 28 is configured to extend in a covering relation with at least a portion of the user's ear. The ear protection potion 28 is preferably configured in a generally wide, semi-circular shape to cover a significant portion of the user's ear and surrounding areas of the face, but any shape that extends in a covering relation with at least a portion of the wearer's ear is contemplated. The ear protection portion 28 also contains a plurality of ventilation openings 20 for passage of air and sound.

The flexible, resilient padding between the inner and outer layers of the various portions of the toddler helmet 10 is formed from any suitable material. Particularly noteworthy for utilization as padding in the toddler helmet 10 are fibrous batt and cellulosic batt. These materials provide the desirable characteristics of cushioning, resiliency, and disposability. Preferably, the entire protective helmet 10 is constructed from disposable material, such as that found in disposable diapers, so that the helmet may be easily disposed of by the parents. This is necessary if, for example, the helmet becomes damaged in some way or if the child simply grows out of the existing helmet. By producing the protective helmet from a disposable material such as that found in disposable diapers, the cost of production may be kept to a minimum such that the prospect of disposing of a helmet and purchasing a replacement helmet is an inexpensive one.

The protective helmet 10 is constructed in several different sizes to accommodate a child as he/she grows. For example, when a "small"-sized protective helmet 10 no longer fits the child's head, it may be disposed of and a "medium"-sized protective helmet 10 used. By choosing a proper size category, using the stretch panels 22,24, and adjusting the straps 16,18, a proper fit is easily established for any child.

The protective helmet 10 is also provided in many different colors. It is particularly appropriate to imprint the outer layers with suitable cartoon characters or aesthetically pleasing designs to make the protective helmet 10 attractive to children. In this way, a child will desire to wear and keep the protective helmet 10 on his/her head, enabling it to perform its protective function.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A protective helmet for use by children to be worn on the head, providing cranial protection to that portion of the head above the level of the ears and to the ears, said helmet comprising:

a padded top portion formed generally as a hollow dome and defining a rim portion, said top portion including an inner layer and an outer layer, with flexible, resilient padding material disposed therebetween, a padded brim formed as a band mounted to and encircling an outer circumference of said top portion and including an inner layer and an outer layer, with flexible, resilient padding material disposed therebetween, a first strap mounted to said padded brim and having a distal end, and a second strap mounted to said padded brim in a spaced relationship with said first strap and having a distal end selectively attachable to and detachable from said distal end of said first strap; and a stretch panel located in said top portion, said stretch panel extending between an upper extent of said top portion and said rim portion and being elastically constructed such that the volumetric capacity of said top portion may be changed by the exertion of pressure from within said top portion.

2. The protective helmet of claim 1, wherein said padded brim further comprises a stretch panel located adjacent to and of similar dimension to said stretch panel of said top portion.

3. The protective helmet of claim 1, wherein said first strap and said second strap each further comprise an ear protection portion at the point of attachment to said padded brim that is configured to extend in a covering relation with at least a portion of a user's ear.

4. The protective helmet of claim 3, wherein said ear protection portion of said first strap and said ear protection portion of said second strap each include an inner layer and an outer layer with flexible, resilient padding disposed therebetween.

5. The protective helmet of claim 4, wherein said flexible, resilient padding includes at least one of a fibrous batt and a cellulosic batt.

6. The protective helmet of claim 3, wherein said ear protection portion of said first strap and said ear protection portion of said second strap each contain a plurality of ventilation openings for the passage of air and sound therethrough.

7. The protective helmet of claim 1, wherein said top portion contains a plurality of ventilation openings to allow for the passage of air therethrough.

8. The protective helmet of claim 1, wherein said flexible, resilient padding of said top portion and said flexible, resilient padding of said padded brim include at least one of a fibrous batt and a cellulosic batt.

9. The protective helmet of claim 1, wherein said protective helmet is constructed of disposable material.

10. A protective helmet to be worn on the head, providing cranial protection to that portion of the head above the level of the ears and to the ears, said helmet comprising:

a top portion formed as a hollow dome, defining a rim portion and having a plurality of ventilation openings formed therein, said top portion including an inner layer and an outer layer, said layers having flexible, resilient padding disposed therebetween, and a stretch panel mounted thereto to extend between an upper extent of said top portion and said rim, said stretch panel being elastically constructed such that the volumetric capacity of the top portion may be changed by the exertion of pressure from within said top portion;

a padded brim formed as a band mounted to and encircling an outer circumference of said top portion at said rim, including an inner layer and an outer layer, with flexible, resilient padding disposed therebetween, said padded brim including a stretch panel located adjacent to and of similar dimension to said stretch panel of said top portion;

a first strap mounted to said padded brim and having a distal end, and a second strap mounted to said padded brim in a spaced relationship with said first strap and having a distal end selectively attachable to and detachable from said distal end of said first strap, said first strap and said second strap each having an ear protection portion at the point of attachment to said padded brim that is configured to extend in a covering relation with at least a portion of a user's ear, said ear protection portions having a plurality of ventilation openings therein, said first strap and said second strap further including an inner layer and an outer layer with flexible, resilient padding disposed therebetween;

said protective helmet being constructed of disposable material.

11. The protective helmet of claim 10, wherein the flexible, resilient padding includes at least one of a fibrous batt and a cellulosic batt.

* * * * *